US005269228A

United States Patent [19]

Mayer et al.

[11] Patent Number: 5,269,228

[45] Date of Patent: Dec. 14, 1993

[54] TRAVELLING MECHANISM OF AN AUTOMATIC SERVICE CARRIAGE FOR SPINNING OR TWISTING MACHINES

[75] Inventors: Walter Mayer, Ingolstadt; Robert Tuschl, Erlangen, both of Fed. Rep. of Germany

[73] Assignee: Rieter Ingolstadt Spinnereimaschinenbau AG, Ingolstadt, Fed. Rep. of Germany

[21] Appl. No.: 917,103

[22] PCT Filed: Nov. 9, 1991

[86] PCT No.: PCT/EP91/02124

§ 371 Date: Sep. 21, 1992

§ 102(e) Date: Sep. 21, 1992

[87] PCT Pub. No.: WO92/11404

PCT Pub. Date: Jul. 9, 1992

[30] Foreign Application Priority Data

Dec. 24, 1990 [DE] Fed. Rep. of Germany ..... 4041855

[51] Int. Cl.[5] ..... D01H 13/26

[52] U.S. Cl. ..... 105/165; 104/89; 104/118; 105/141

[58] Field of Search ..... 104/89, 118; 105/148, 105/165, 168, 167, 170, 141; 57/261, 263, 264, 268

[56] References Cited

U.S. PATENT DOCUMENTS

| | | | |
|---|---|---|---|
| 2,549,954 | 4/1951 | Zimmerman | 105/170 |
| 4,389,943 | 6/1983 | Watatani | 105/170 |
| 4,398,469 | 8/1983 | Zelli | 105/170 |
| 4,840,022 | 6/1989 | Karl et al. | 57/261 |

FOREIGN PATENT DOCUMENTS

| | | |
|---|---|---|
| 0046210 | 2/1982 | European Pat. Off. . |
| 3833739 | 4/1989 | Fed. Rep. of Germany . |
| 1181451 | 2/1970 | United Kingdom . |

*Primary Examiner*—Mark T. Le
*Attorney, Agent, or Firm*—Dority & Manning

[57] ABSTRACT

The instant invention relates to a travelling mechanism of automatic service carriages for spinning or twisting machines. The invention includes a travelling mechanism having a supporting wheel mounted in a pivot bearing, the guiding axis of the pivot bearing coinciding with the central vertical axis of the supporting wheel. The pivot bearing is connected via a connecting link to a swivel bearing installed on the travelling gear. The connecting link is arrested on either side by a fixed stop and a swivelling latch.

9 Claims, 5 Drawing Sheets

TRAVELLING MECHANISM OF AN AUTOMATIC SERVICE CARRIAGE FOR SPINNING OR TWISTING MACHINES

BACKGROUND OF THE INVENTION

The instant invention relates to a travelling mechanism of an automatic service carriage for spinning or twisting machines whereby said automatic service carriage travels on a rail system to work stations and must travel over a curved track at the front of the machine so as to move from one side of the machine to the other.

The automatic service carriage is a self-contained assembly which must be positioned for technical reasons in one plane of movement at different locations of the textile machine. For this purpose the automatic service carriage is mounted on a running rail system. The running rail system, which consists of an outer and inner running rail is attached to the machine frame by means of supports. The automatic service carriage includes guide rollers attached to an extension bracket upon the inner running rail while the running and guide rollers of the automatic service carriage are guided on the outer running rail.

The configuration of the outer running rail system with moving gear determines the travelling attitude.

The moving gear of the automatic service carriage must therefore ensure precise guidance in relation to the work stations of the textile machine and also in travelling over curves on the outer curved track. Due to the relatively high speed as well as great weight and volume of the automatic service carriage, an unsteady transport movement is produced in curve travel.

In a known device a running wheel is rigidly installed on each of the two ends of the travelling gear of the automatic service carriage, whereby the fork of the running wheel is rotatably mounted by means of a spherical gudgeon. The formation of a wheel flange on each side of the running wheels is necessary in order to ensure true gauge in transport. Curve travel on the rail produces a high degree of sliding friction due to the different circumferential speeds of the two wheel flanges of a wheel, leading to spontaneously unsteady running and wear.

Another known development consists in equipping this running wheel with wheel flanges on both sides rotatably and independently of each other, facing the running wheel. However this solution avoids neither wear at the friction points nor spontaneous braking action.

Another device according to DE-OS 38 33 739 omits wheel flange elements on the running wheel. Three guide rollers with axles that are parallel to the guide axles of the running wheel are provided on the sides of the track in addition to the running wheel and are connected to the latter. It is a particularity of this arrangement that at least two guide rollers run in different radial planes on one edge of the curved track and that the curved track has two different radii. However, since at least two running wheels are still rigidly coupled together over a defined distance, sliding friction on the running wheels remains and sufficiently steady travel of the automatic service carriage is still not ensured.

OBJECTS AND SUMMARY OF THE INVENTION

It is an object of the instant invention to improve the travelling characteristics of the automatic service carriage as it travels on curves on a rail system of the textile machine so as to achieve a steady, continuous travelling motion of the automatic service carriage while avoiding sliding friction and spontaneous yaw of the running wheel.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The automatic service carriage is provided with a travelling gear above the supporting rail with guiding rollers on its underside to hold the automatic service carriage on the rail. One moving gear is installed on each of the two edges of the travelling gear.

The moving gear contains the supporting wheel which is mounted in a movable fork, the fork being supported in a pivot bearing which allows the support wheel to rotate about a vertical axis through the bearing. The axle of the pivot bearing extends in the central vertical plane of the supporting wheel. On both sides of the rail, paired guide wheels are provided in prolongation of the fork arms, the rotational axle of these guide wheels being parallel to the axle of the pivot bearing. The pivot bearing is connected via a connecting link to a swivel bearing. The swivel bearing in turn in connected to the travelling gear. When the movement of the moving gear is linear, the connecting link is held in position by stops engaging both sides of the connecting link parallel to the direction of travel. Swivelling of the connecting link relative to the rail and away from the machine is prevented by a rigidly fixed stop on the travelling gear. Swivelling of the connecting link relative to the rail but towards the machine side is limited by means of a stop in form of a latch which can be unlatched. When the movement of the automatic service carriage is linear, the carriage is therefore guided securely and tilting is prevented. Such tilting could occur otherwise because of the operation of different assemblies installed in the automatic service carriage. On the other hand, such tilting could also be caused by the drag chain of the electric cable since the latter is dragged in the direction of travel of the automatic service carriage while it is pushed in the other direction.

A roller feeler forms part of the moving gear and is connected via a rod running vertically to a latch, the roller feeler being rotatably mounted to the rod, which is pivotally mounted to the latch. Immediately before the beginning of the curved track, a cam of a length equal to the distance between the two roller feelers of the two moving gears is installed on the lateral surface of the track away from the machine side and in the direction of travel.

As the automatic service carriage travels around the curved track, steady and low-wear travel is achieved because the supporting wheels of the moving gear are mounted in a pivot bearing making it possible for the supporting wheel to be adapted to the curve of the rail. To ensure that the automatic service carriage must not come too close to the machine in this phase, provisions are further more made for the pivot bearing to be connected via a connecting link to a swivel bearing so that the supporting wheel is enabled to execute a horizontal swivelling motion with respect to the longitudinal axis of the travelling gear. This rotatable change of position is however only possible if the first roller feeler lifts the latch up and out via the connecting rod by means of the roller feeler riding up onto the cam at the beginning of the curved track. The latch is then deposited on the narrow side of the connecting link and thereby cancels out the stopping action on one side so that the supporting wheel is able to swivel in relation to the travelling gear, following the course of the curved track.

Swivelling of the leading supporting wheel is, however, presented for a short distance. The travelling gear of the automatic service carriage is forced by the arrangement of an auxiliary roller and auxiliary rail to continue its linear travel until the following connecting link and associated supporting wheel is unlocked, and to swivel only then. The auxiliary rail and auxiliary roller support the automatic service carriage in this transitional zone of the track and prevent a jolting transition to the curved track.

The arrangement at the entrance of the curved track is similar to that at the exit of the curved track, so that supporting and locking functions can be carried out at either side of the curved track depending upon the direction of travel of the travelling gear.

After continued travel of the automatic service carriage, the trailing roller feeler of the second or trailing moving gear slides upon the cam and also releases the one-sided stopping of the connecting link of the associated supporting wheel, which can then swivel out of the linear direction of travel in accordance with the curvature of the rail and swivel in relation to the travelling gear, whereby the running roller of the travelling gear rolls off the angled plane of the auxiliary cam.

The trailing roller feeler slides prematurely off the cam ridge as a function of the curvature radius. For this reason, the outer edge of the cam is bevelled in the center on the upper ridge in order to assist the roller feeler in leaving the ridge prematurely.

When the automatic service carriage has continued on its way and the roller feelers have left the cam, the corresponding latch remains open until the associated roller feeler again meets up with a second cam as it travels along the curved track and lifts the latch thereby once again locking the supporting wheel in position.

BRIEF DESCRIPTION OF THE DRAWINGS

Embodiments are explained below through drawings in which.

DESCRIPTION OF THE PREFERRED EMBODIMENTS

Reference will now be made in detail to the present preferred embodiments of the invention, examples of which are illustrated in the accompanying drawings.

Figure 1:
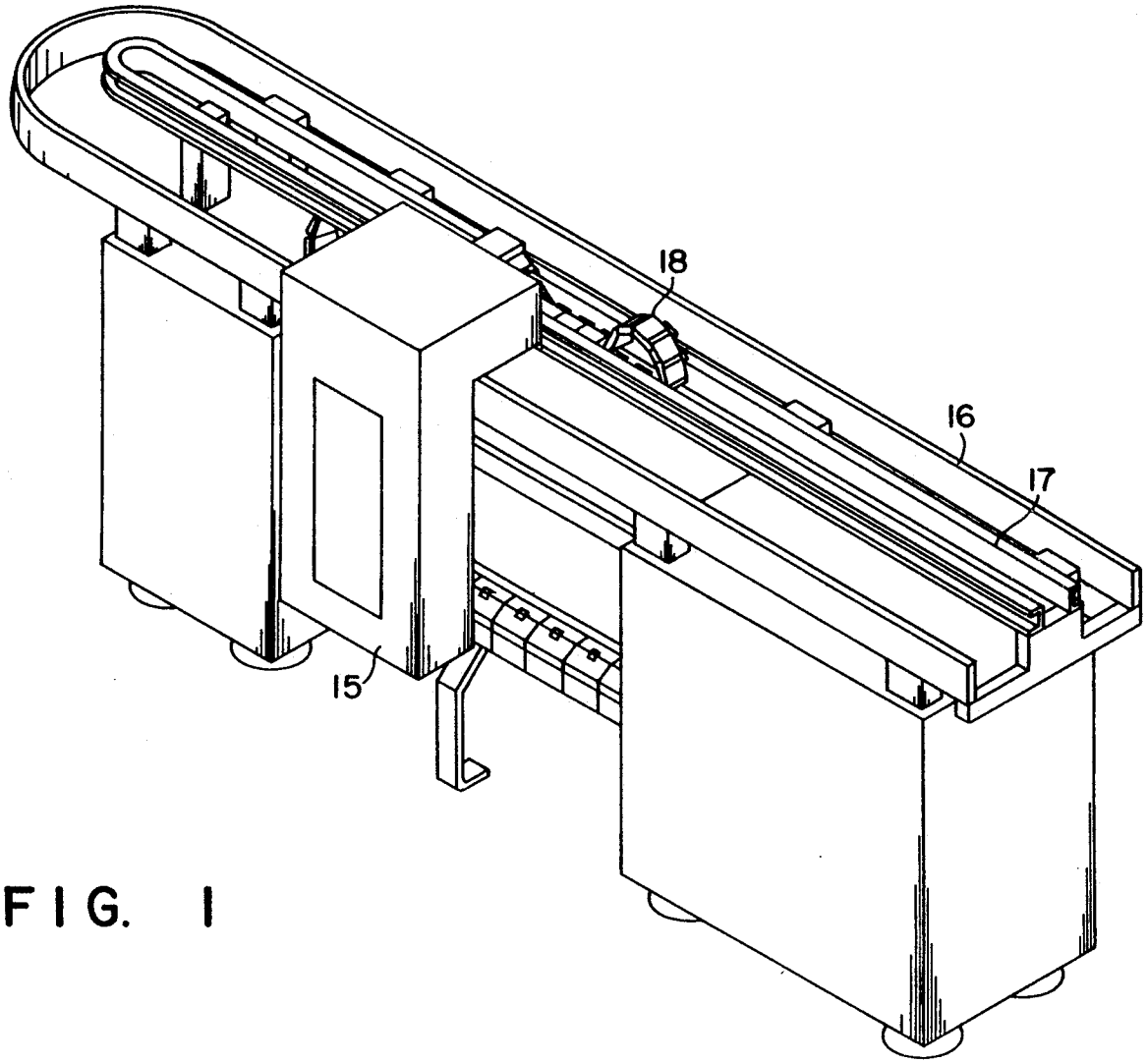
FIG. 1 is a perspective view showing an arrangement of a track system and an automatic service carriage in relation to the spinning machine.

FIG. 1 shows the path that an automatic service carriage (15) must travel when changing from one side of a spinning machine to the other along a curved track. Outer rail 16 and inner rail 17 generally define the curved track.

Figure 2:
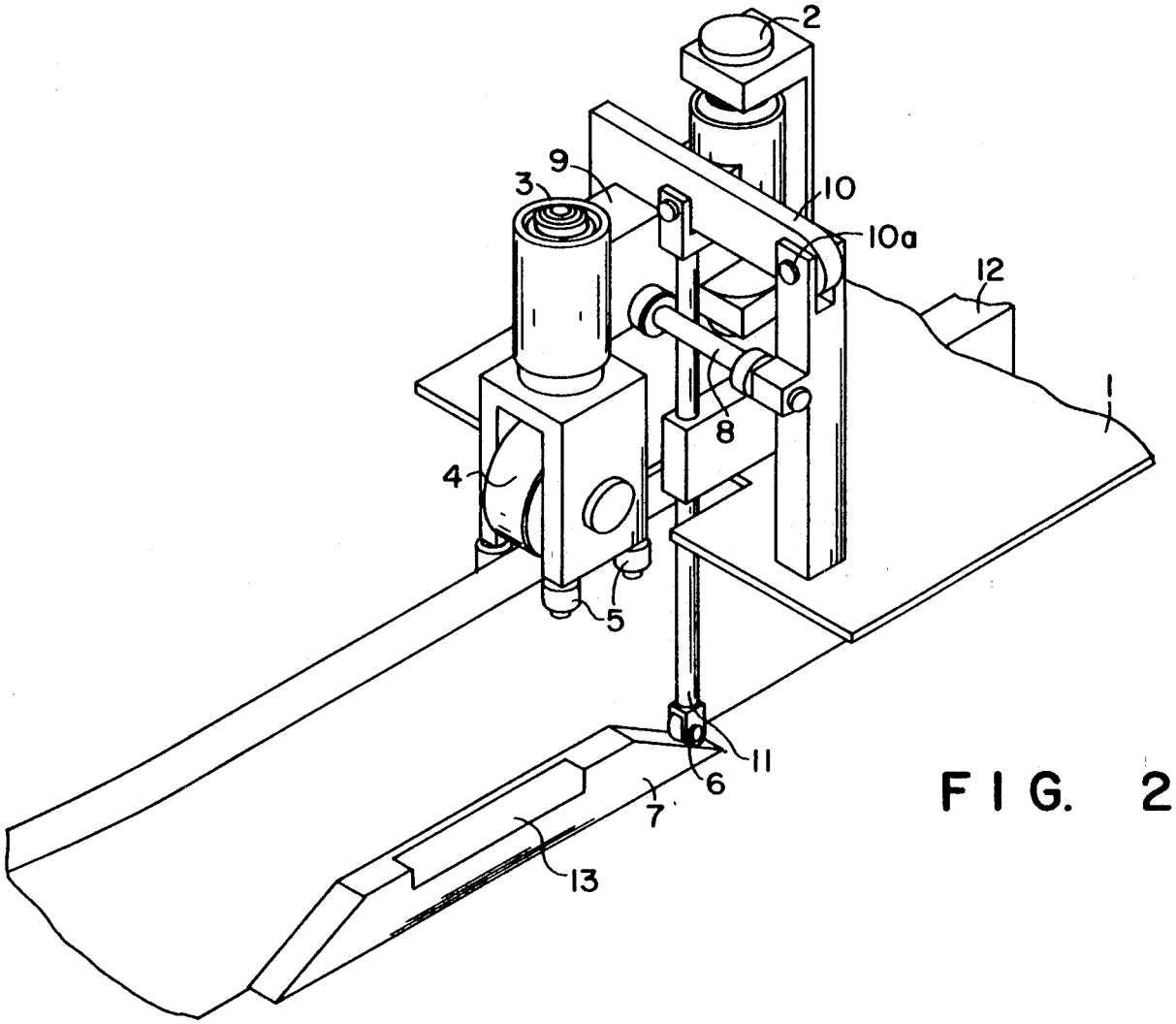
FIG. 2 is a perspective view of an embodiment of the moving gear in relation to the travelling gear of the invention.
Figure 3:
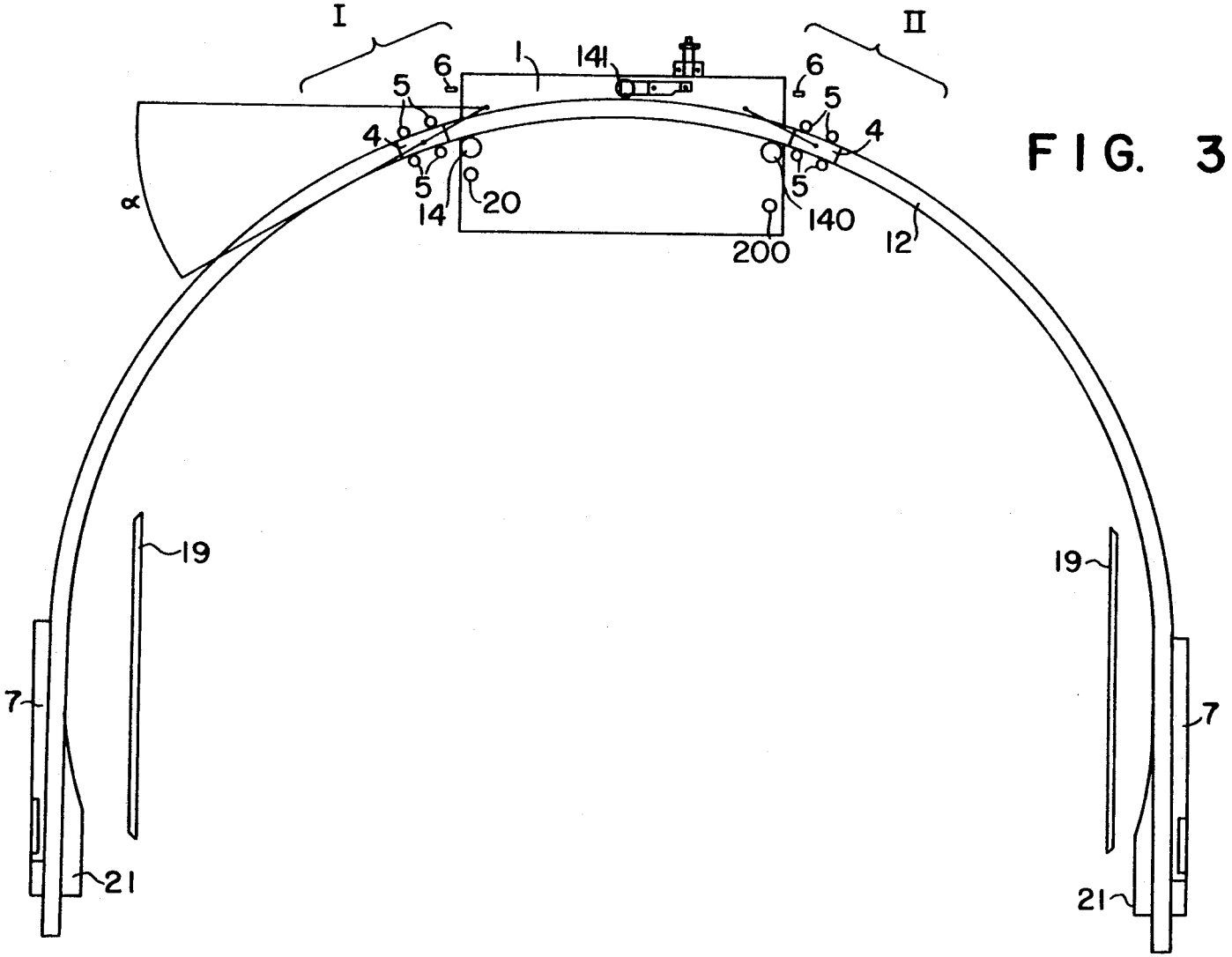
FIG. 3 is a plan view from below of the track with travelling gear and associated moving gear at each end thereof according to the invention.
Figure 4:
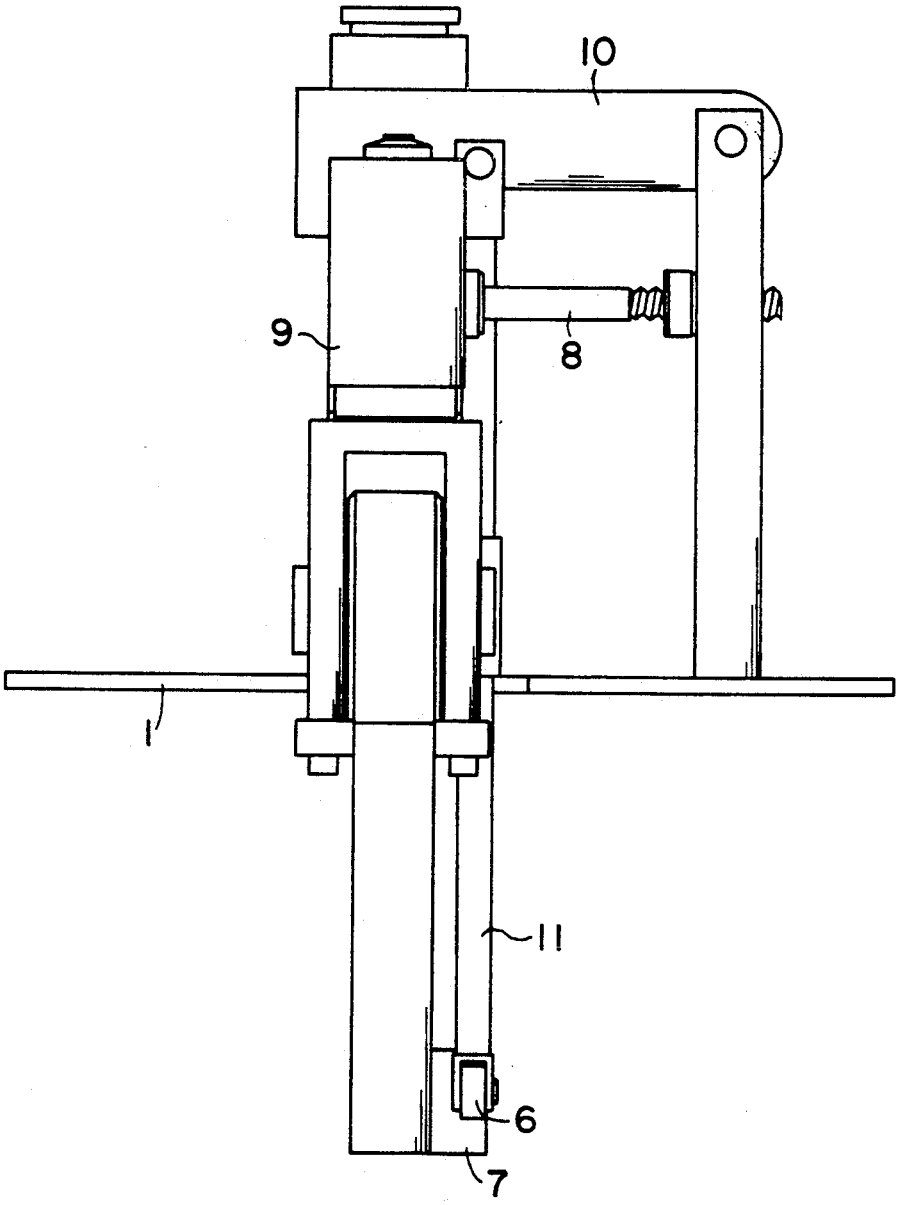
FIG. 4 is a side elevational view of a connecting link between a pivot bearing and a swivel bearing.

Swivelling of moving gear I as well as of moving gear II in relation to the travelling gear (1) is illustrated particularly in FIG. 3. As shown in FIG. 3, travelling gear (1) is able to swivel in the curved track in the plane of the track surface by a swivelling angle $\alpha$ in relation to the longitudinal axis of travelling gear (1). Moving gear I and moving gear II are unlocked in FIG. 3 since traveling gear 1 is completely on the curved potion of rail 12. Referring to FIGS. 2 and 4 particularly, this was by connecting link (9) being unlatched by latch (10) via rod connection (11) by means of cam (7) and roller feeler (6) as it rolled up on cam 7. As illustrated in FIGS. 2 and 4, as roller feeler 6 rolls onto inclined cam 7, this forces connecting rod 11 upward causing latch 10 to pivot about point 10*a*. Latch 10 then moves out of engagement with connecting link 9. Moving gear I or II can then swivel by means of pivot bearing 3 and swivel bearing 2, as is readily apparent from the figures. This also applies to moving gear II. Due to the fact that the moving gear I and the moving gear II can be swivelled, yawing of supporting wheels (4) is avoided. Also, the damaging sliding friction of guide wheels (5) is avoided.

The cams (7) which cause latch 10 to open when the roller feeler (6) runs up on the cams are installed in the linear track side section before the beginning of the curved track and after its end, as shown particularly in FIG. 2. The direction of travel of the automatic service carriage can be freely selected in either direction. When the automatic service carriage leaves the curved track, roller feeler 6 of the leading moving gear first locks the connecting link 9 of the forward moving gear through the latch mechanism 10. As travel is continued the connecting link 9 of the trailing moving gear is also locked by its roller feeler 6 and latch mechanism 10.

Figure 5:
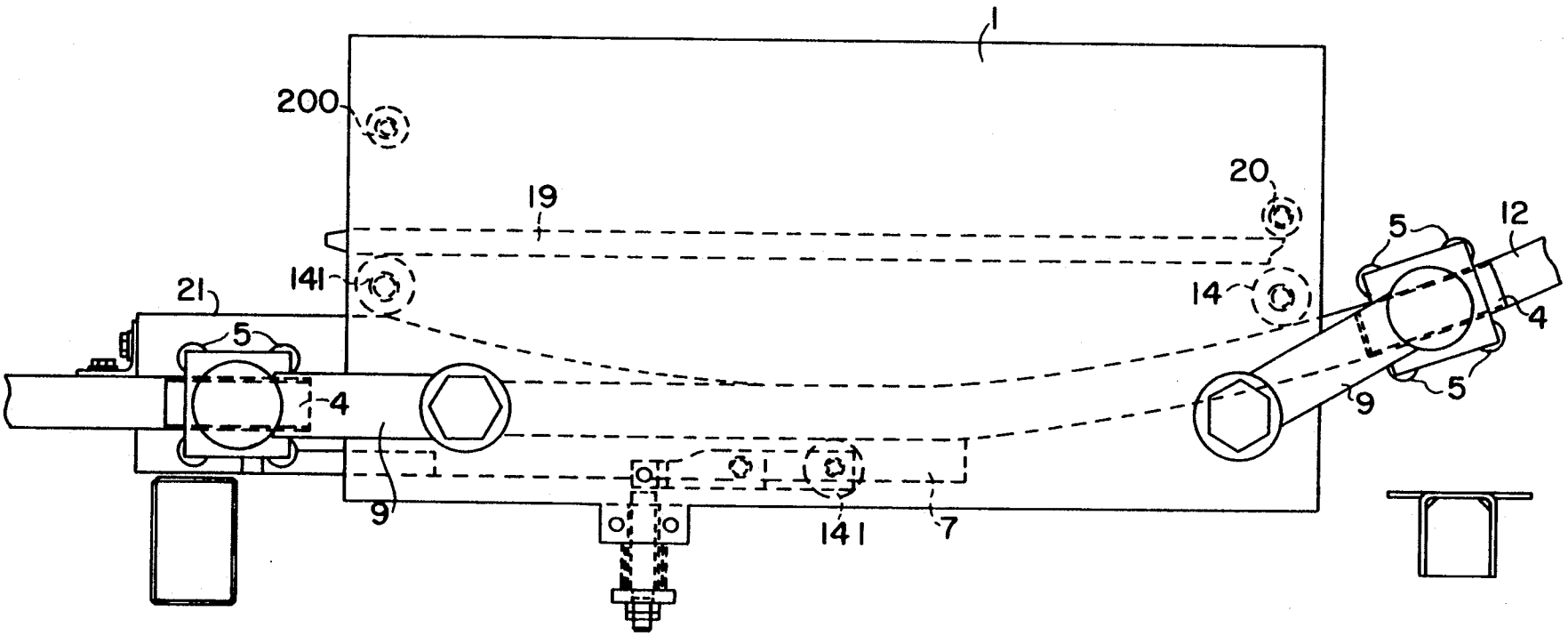
FIG. 5 is a plan view from below of a travelling gear showing the mechanism of an auxiliary rail and auxiliary roller.

According to FIG. 5, when the first connecting link (9) is unlocked, the travelling gear (1) is forced by the placement of the auxiliary roller (20), running roller (14) and the auxiliary rail (19) to continue in linear travel until the trailing connecting link (9) is unlocked and to swivel only then, with the trailing running roller (14) rolling off the auxiliary cam. As shown in FIG. 3, the spacing between auxiliary roller (20) and running roller (14) of the leading moving gear I is smaller than the spacing between auxiliary roller (200) and running roller (140) of trailing moving gear II. Likewise, the space between auxiliary rail (19) and rail (12) on the right hand side of the track is less than that on the left hand side of the track. Thus, it should be understood, as depicted in FIG. 3, that regardless of the direction of travel of travelling gear (1), the auxiliary roller (20 or 200) and running roller (14 or 140) of the leading moving gear (I or II) will engage a respective auxiliary rail (19) as traveling gear (1) approaches the curved portion of rail 12. Thus, premature swivelling of the leading moving gear is prevented until the trailing moving gear is unlatched. When the travelling gear (1) leaves the curved portion of rail 12, the trailing auxiliary roller (20 or 200) and running roller (14 or 140) will engage rail 19 forcing gear (1) into a straight path.

The travelling gear swivels with its forward side by a swivelling angle ($\alpha$) so that the trailing roller feeler leaves the cam laterally at bevelled edge 13 after unlocking of the second connecting rod. The edge (13) of the cam is bevelled to facilitate the transition.

FIG. 4 shows how the connecting link (9) is arrested by the stop (8) and the latch (10). As it is unlatched, the latch nose comes to rest on the back of the connecting link (9). The width of the connecting link (9) is sized so that the latch nose is unable to leave the connecting link (9) at the maximum swivelling angle $\alpha$.

The connecting link is latched again as it is brought again against a stop (8) when straight travel begins and the latch nose is brought beyond the back of the connecting link and catches in the arresting position.

We claim:

1. A travelling mechanism for use with an automatic service carriage for servicing textile machines, the textile machines having a track system with a substantially continuous guide rail extending along both sides of the machine and around at least one end thereof, said travelling mechanism travelling along the guide rail in either direction so as to service stations on both sides of the textile machine, said travelling mechanism comprising:

a travelling gear;

a moving gear mounted to each end of said travelling gear, each said moving gear including a supporting wheel in running engagement with the machine guide rail;

means for pivotally connecting each said supporting wheel with its respective said moving gear so that each said supporting wheel can swivel about a vertical axis through said supporting wheel;

means for pivotally connecting each said moving gear to said travelling gear so that each said moving gear can swivel about a vertical axis through said travelling gear as said travelling gear travels along curved portions of the machine guide rail; and means for locking said moving gears in position relative said travelling gear along straight portions of the machine guide rail and for unlocking said moving gears relative said travelling gear along curved portions of the machine guide rail.

2. The travelling mechanism as in claim 1, wherein said means for pivotally connecting said supporting wheels to said moving gears comprises a pivot bearing, and said means for pivotally connecting said moving gears to said travelling gear comprises a swivel bearing, and further comprising a connecting link between said pivot bearing and said swivel bearing.

3. The travelling mechanism as in claim 2, wherein said means for locking said moving gears comprises a latch configured to engage said connecting link between said pivot bearing and said swivel bearing, said latch being pivotally mounted relative to said travelling gear so as to disengage said connecting link during travel of said travelling gear along curved portions of the machine guide rail and to engage said connecting link during travel of said travelling gear along straight portions of the machine guide rail.

4. The travelling mechanism as in claim 3, further comprising a rod operatively attached to said latch, and a cam positioned along the machine guide rail generally where the guide rail merges from its straight portion to its curved portion, said rod engaging said cam as said travelling gear travels therepast thereby actuating said latch to disengage said connecting link.

5. The travelling mechanism as in claim 4, wherein said cam comprises sloped end portions leading to the top surface of said cam and a center portion bevelled away from the machine guide rail.

6. The travelling mechanism as in claim 1, further comprising means for actuating said locking means of each said moving gear in sequence in the direction of linear travel of said travelling gear from the straight portion of the machine guide rail to the curved portion of the machine guide rail so that the leading said moving gear in the direction of travel is unlocked before the trailing said moving gear is unlocked.

7. The travelling mechanism as in claim 6, further comprising means for maintaining said leading moving gear fixed in position relative said travelling gear after said leading moving gear is unlocked until said trailing moving gear is unlocked.

8. The travelling mechanism as in claim 7, wherein said maintaining means comprises a substantially straight auxiliary rail positioned beside the machine guide rail generally where the machine guide rail merges from its straight portion to its curved portion, and an auxiliary roller fixed in position on the leading end of said travelling gear in the direction of travel, said auxiliary roller engaging said auxiliary rail until said trailing moving gear is unlocked.

9. A travelling mechanism for use with an automatic service carriage for servicing a textile machine, the textile machine utilizing a substantially continuous guide rail extending along both sides of the machine and around at least one end thereof, said travelling mechanism travelling along the guide rail in either direction so as to service stations on both sides of the textile machine, said travelling mechanism comprising:

a travelling gear;

a moving gear mounted to each end of said travelling gear through a swivel bearing, each said moving gear including a supporting wheel in running engagement with the machine guide rail, said supporting wheel mounted to said moving gear through a pivot bearing;

a connecting link connecting said swivel bearing to said pivot bearing;

a latch operatively configured to engage said connecting link between said pivot bearing and said swivel bearing, said latch being pivotally mounted relative to said travelling gear so as to disengage from said connecting link during travel of said travelling gear along curved portions of the machine guide rail and to engage said connecting link during travel of said travelling gear along straight portions of the machine guide rail;

a rod operatively attached to said latch, and a cam positioned along the machine guide rail generally where the guide rail merges from its straight portion to its curved portion, said rod engaging said cam as said travelling gear travels therepast thereby actuating said latch to disengage from said connecting link so that said moving gear of the leading edge of said travelling gear in the direction of travel from the straight portion of the machine guide rail to the curved portion thereof is unlatched and able to swivel relative said travelling gear in sequence before said moving gear of the trailing edge of said travelling gear is unlatched by engagement of its respective said rod with said cam; and a substantially straight auxiliary rail positioned beside the machine guide rail generally where the machine guide rail merges from its straight portion to its curved portion, and an auxiliary roller fixed in position on the leading end of said travelling gear in the direction of travel, said auxiliary roller engaging said auxiliary rail until said trailing moving gear is unlatched.

* * * * *